US008099846B2

(12) United States Patent
King et al.

(10) Patent No.: US 8,099,846 B2
(45) Date of Patent: Jan. 24, 2012

(54) STEM COLLECTION CONTAINERS FOR FASTENING TOOLS

(75) Inventors: Richard Paul King, Welwyn (GB); Marc Gaussin, Saint Maur (FR)

(73) Assignee: Avdel UK Limited, Welwyn Garden, Hertfordshire (GB)

( * ) Notice: Subject to any disclaimer, the term of this patent is extended or adjusted under 35 U.S.C. 154(b) by 246 days.

(21) Appl. No.: 12/162,427

(22) PCT Filed: Jul. 10, 2007

(86) PCT No.: PCT/GB2007/002586

§ 371 (c)(1),
(2), (4) Date: May 7, 2009

(87) PCT Pub. No.: WO2008/040927

PCT Pub. Date: Apr. 10, 2008

(65) Prior Publication Data

US 2009/0300895 A1 Dec. 10, 2009

(30) Foreign Application Priority Data

Oct. 3, 2006 (GB) ..... 0619432.8

(51) Int. Cl.
*B21J 15/18* (2006.01)
*B21D 31/00* (2006.01)

(52) U.S. Cl. ..... 29/243.523; 29/243.524; 29/243.525; 72/391.4

(58) Field of Classification Search ..... 29/243.521, 29/243.522, 243.523, 243.524, 243.525; 72/391.4, 391.6

See application file for complete search history.

(56) References Cited

U.S. PATENT DOCUMENTS 4,454,746 A * 6/1984 Schwab ..... 29/243.525

(Continued)

FOREIGN PATENT DOCUMENTS

GB 2 372 475 A 8/2002

(Continued)

OTHER PUBLICATIONS

Textron Fastening Systems Commercial Solutions: TX2000 Service Manual, No. 07-900-00760, Jan. 2002, GB.

*Primary Examiner* — David Jones
(74) *Attorney, Agent, or Firm* — Hahn, Loeser & Parks LLP; Arland T. Stein

(57) ABSTRACT

A container (12) for use with a tool (2) for installing fasteners of the type in which a part of the fastener is broken off during installation, the tool (2) having a body, the container (12) being for collecting broken-off fastener parts during operation of the tool, the container (12) comprising: attachment means (20, 21) for removably attaching the container (12) to the body (8) of the tool, the attachment means (20, 21) being resiliently biased into attachment with the body (8) by resilient biasing means; and one or more contact region (22, 23) for receiving manual pressure from a user, at least one of the said one or more contact regions (22, 23) being coupled to the attachment means (20, 21); wherein the resilient biasing means are such that the attachment means (20, 21) can be detached from the body of the tool by the user applying manual pressure on the said one or more contact regions (22, 23) thereby detaching the container (12) from the body of the tool (2). Also provided is a fastener installation tool (2) having such a container (12).

29 Claims, 15 Drawing Sheets

U.S. PATENT DOCUMENTS

| | | | | | |
|---|---|---|---|---|---|
| 4,887,450 | A | * | 12/1989 | Gast et al. | 29/243.523 |
| 4,888,974 | A | * | 12/1989 | Mandell | 29/243.523 |
| 5,086,551 | A | * | 2/1992 | Shamaly et al. | 29/243.523 |
| 5,490,311 | A | * | 2/1996 | Rosier | 29/243.523 |
| 5,806,160 | A | * | 9/1998 | Frearson et al. | 29/243.523 |
| 6,021,553 | A | * | 2/2000 | Bieber et al. | 29/243.521 |
| 6,163,945 | A | * | 12/2000 | Amano et al. | 29/243.523 |
| 6,276,037 | B1 | * | 8/2001 | Solfronk | 29/243.525 |
| 6,301,948 | B1 | * | 10/2001 | Weiland | 72/391.6 |
| 6,925,695 | B2 | * | 8/2005 | Woyciesjes et al. | 29/243.525 |
| 7,290,317 | B2 | * | 11/2007 | Kato et al. | 29/243.521 |

FOREIGN PATENT DOCUMENTS

| | | | |
|---|---|---|---|
| WO | 96/38245 | A1 | 12/1996 |

* cited by examiner

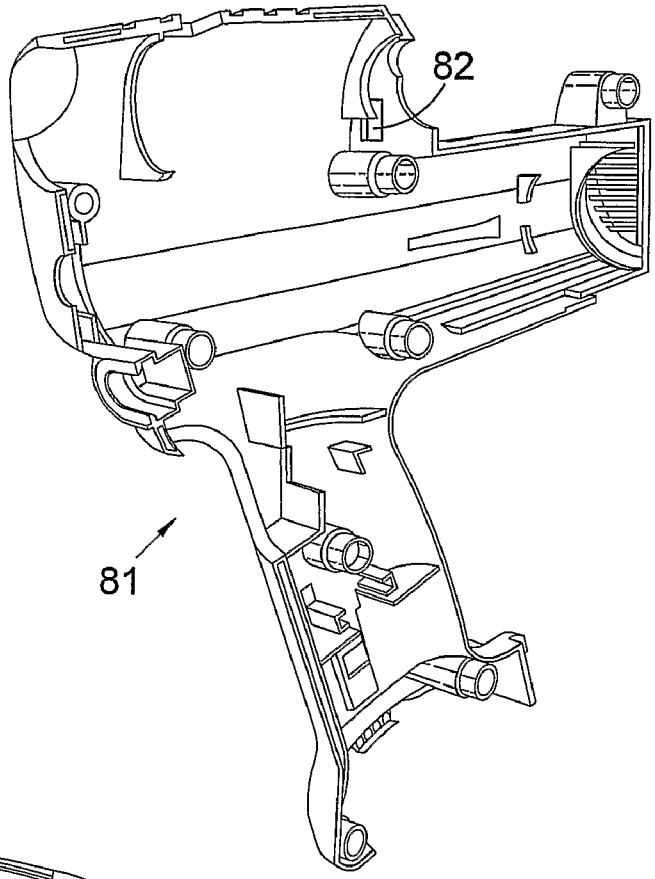
Fig.15
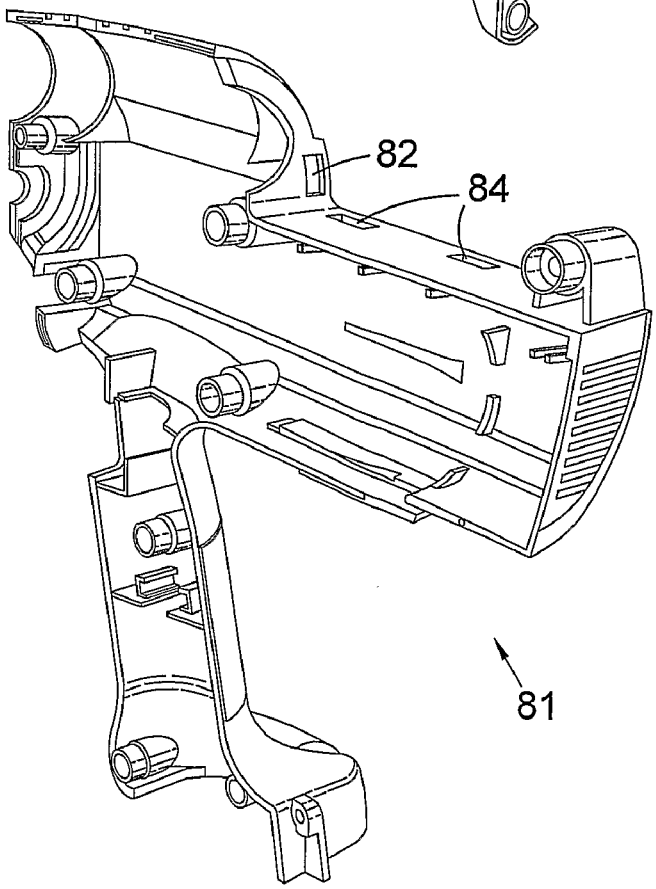

STEM COLLECTION CONTAINERS FOR FASTENING TOOLS

Related/Priority Application

This application is a National Phase filing regarding International Application No. PCT/GB2007/002586, filed on Jul. 10, 2007. International Application No. PCT/GB2007/002586 relies upon British Application No. 0619432.8, filed on Oct. 3, 2006 for priority.

This invention relates to fastener installation tools provided with collection means for collecting broken-off fastener parts, i.e. that part of each fastener which is broken off during the installation process. It is particularly applicable, but by no means limited, to breakstem riveting tools, in which part of the stem of the rivet breaks off during installation.

Breakstem riveting tools have been well known for many years. A typical example of such a tool is described in our earlier specification WO 96/38245, to which the reader is referred for further information about the construction, operation and practical requirements of such tools. Further background art is provided in GB 2372475 A.

A stem collection container is provided as part of a breakstem riveting tool, to retain the stems that are broken off the rivets during installation. With some tools, the stem collection container may be removeable from the tool in order to be emptied. In other tools, the container may be an integral (non-removeable) part of the tool, with an openable lid to enable the stems to be tipped out.

Some current breakstem riveting tools, such as the TX2000 breakstem battery powered tool, have a stem collector lid that is attached to the tool body by a hinge. With such a tool, the entire tool needs to be lifted and tipped in order to remove all the broken stems from the container, and this can be cumbersome and awkward in practice. Also, if the container becomes damaged in use, the tool case mouldings have to be removed to replace the part.

Other pre-existing stem collection containers employ a spring loaded lid, or a threaded or grooved rotating mechanism for removing the container from the tool. Such containers can be time consuming and cumbersome to remove, empty, and replace on the tool. Moreover, such a procedure is not suited to single-handed operation.

There is therefore a desire for a stem collection container having a quick release mechanism which enables the container to be easily detached, emptied and replaced on the tool, without undue delay, and preferably single-handedly.

According to a first aspect of the present invention there is provided a container for use with a tool for installing fasteners of the type in which a part of the fastener is broken off during installation, the tool having a body, the container being for collecting broken-off fastener parts during operation of the tool, the container comprising: attachment means for removably attaching the container to the body of the tool, the attachment means being resiliently biased into attachment with the body by resilient biasing means; and one or more contact regions for receiving manual pressure from a user, at least one of the said one or more contact regions being coupled to the attachment means; wherein the resilient biasing means are such that the attachment means can be detached from the body of the tool by the user applying manual pressure on the said one or more contact regions, thereby detaching the container from the body of the tool.

The term "coupled" as used herein should be interpreted broadly, to encompass both mechanical coupling, and any other form of coupling, for example electrical or electromagnetic coupling.

The provision of the one or more contact regions being coupled to the attachment means advantageously enables the container to be quickly and easily removed from the tool for emptying. By virtue of the attachment means being resiliently biased into attachment with the body, the container can readily be reattached to the tool. Thus, a quick release (and quick reattachment) mechanism is provided for the container.

Preferably the container further comprises: a first wall having a first contact region; and a second wall having a second contact region.

Preferably the first wall substantially opposes the second wall. This advantageously enables the user to grip the two contact regions between his thumb and fingers, thereby enabling simple single-handed removal of the container from the tool.

Preferably the first wall further comprises first attachment means, and the second wall further comprises second attachment means.

Preferably the first and second attachment means are integrally formed with the first and second walls respectively. This advantageously simplifies and facilitates manufacture of the container.

Preferably the first and second contact regions are integrally formed in the first and second walls respectively. This further simplifies and facilitates manufacture of the container.

Particularly preferably at least part of the first and/or second walls is/are formed of a resiliently flexible material which provides the resilient biasing means. By virtue of the wall material serving as the resilient biasing means, this yet further simplifies and facilitates manufacture of the container.

The first and/or second walls may incorporate one or more apertures or recesses arranged to facilitate the resilient flexing of the material. The term "apertures" as used here in should be interpreted broadly, to encompass open-ended holes or slots, as well as holes that are bounded on all sides.

By way of example, the resilient material may be a polymer material, such as a polycarbonate or a rubber, or a metallic material. Other suitable materials will be apparent to those skilled in the art of materials selection.

In some embodiments, the attachment means comprise protrusions configured to engage with corresponding apertures or recesses or such like on the body of the tool. The protrusions may be in the form of ridges which protrude perpendicularly from the first and second walls.

In other embodiments, the container may further comprise one or more arms extending from the container, the said arm(s) being resiliently biased and incorporating attachment means and a contact region. The attachment means may comprise one or more protrusions.

In alternative embodiments, the attachment means provided on the container may comprise one or more apertures or recesses, configured to engage with corresponding protrusions or such like on the body of the tool.

The container may further comprise one or more feet adapted to locate in one or more corresponding apertures or recesses in the body of the tool. These feet, which may be L-shaped, advantageously assist in securing the container to the body of the tool during use.

Advantageously, the container may further comprise a ridge, protrusion or partition on an internal surface of the container, the said ridge, protrusion or partition being arranged to prevent broken stems from jamming across the width of the container.

According to a second aspect of the invention there is provided a fastener installation tool having a container in accordance with the first aspect of the invention.

Embodiments of the invention will now be described, by way of example only, and with reference to the drawings in which:

FIG. 15 illustrates a design of a tool body suitable for use with the container of the third embodiment.

In the figures, like elements are indicated by like reference numerals throughout.

Figure 4:
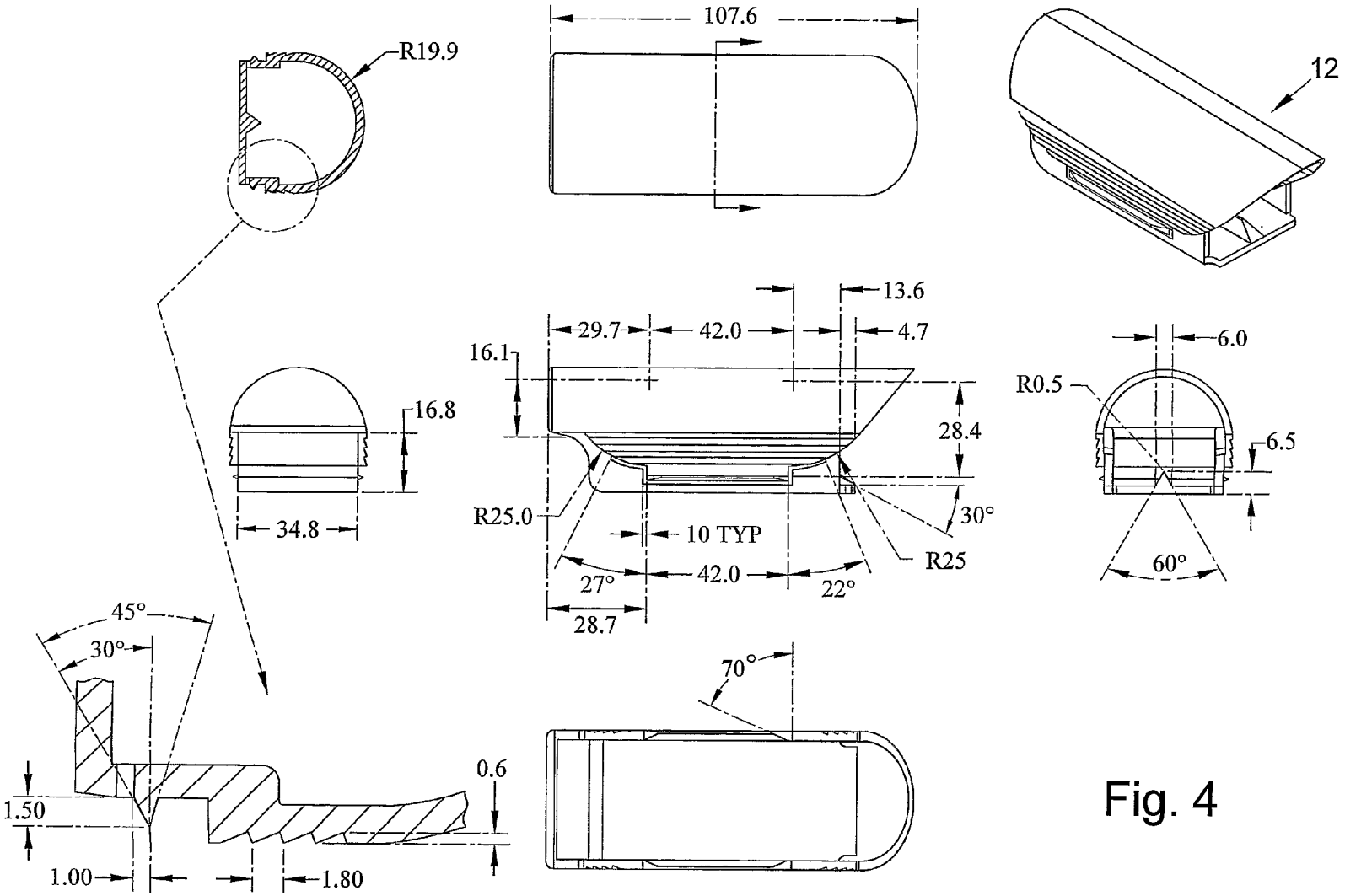
FIG. 4 illustrates the views of FIG. 3 with example dimensions in millimetres.
Figure 9:
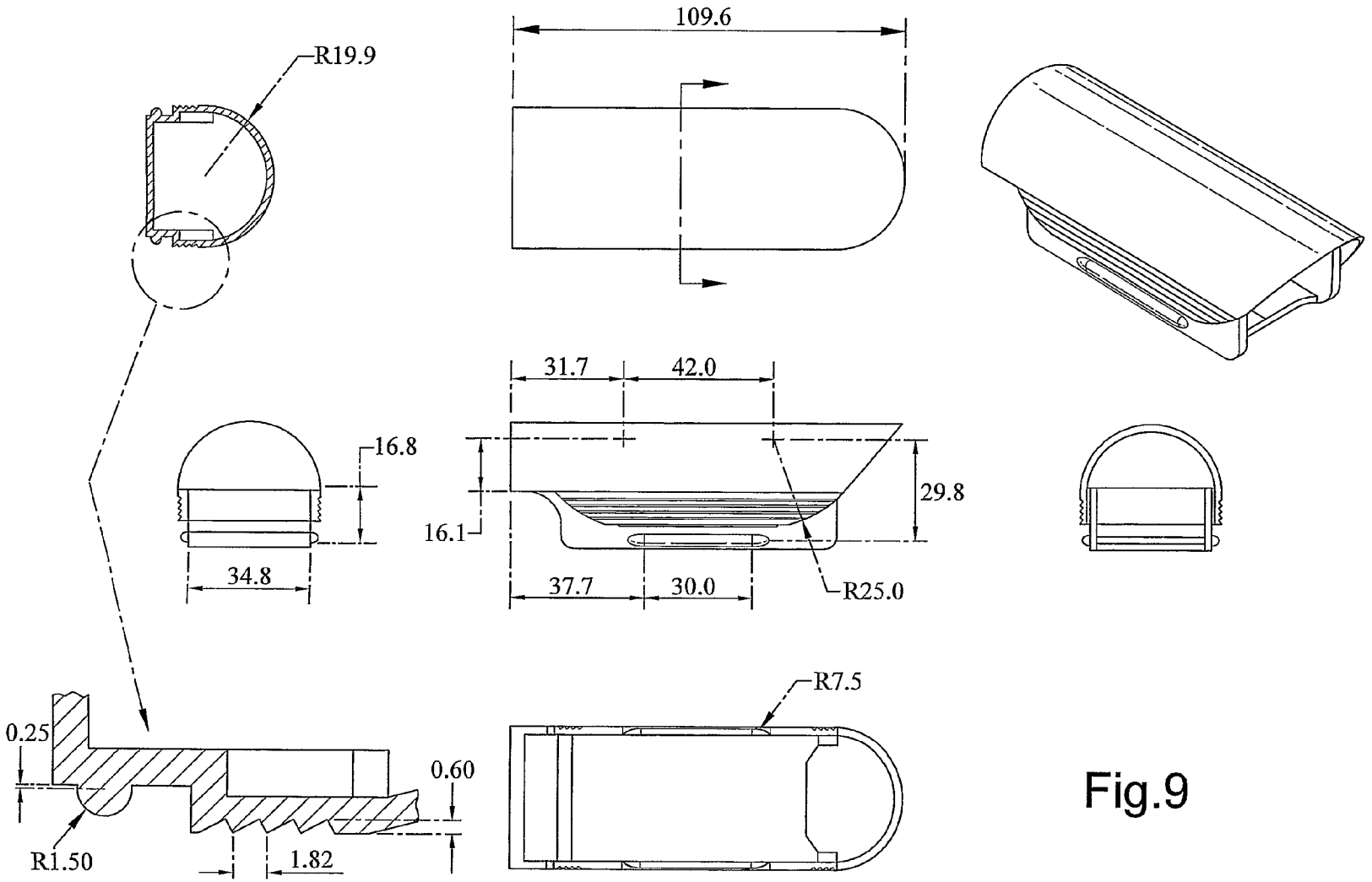
FIG. 9 illustrates the views of FIG. 8 with example dimensions in millimetres

The dimensions in FIGS. 4 and 9 are provided by way of example only, as the embodiments may be made in a variety of shapes and sizes.

The present embodiments represent the best ways known to the applicant of putting the invention into practice. However they are not the only ways in which this can be achieved.

Figure 1:
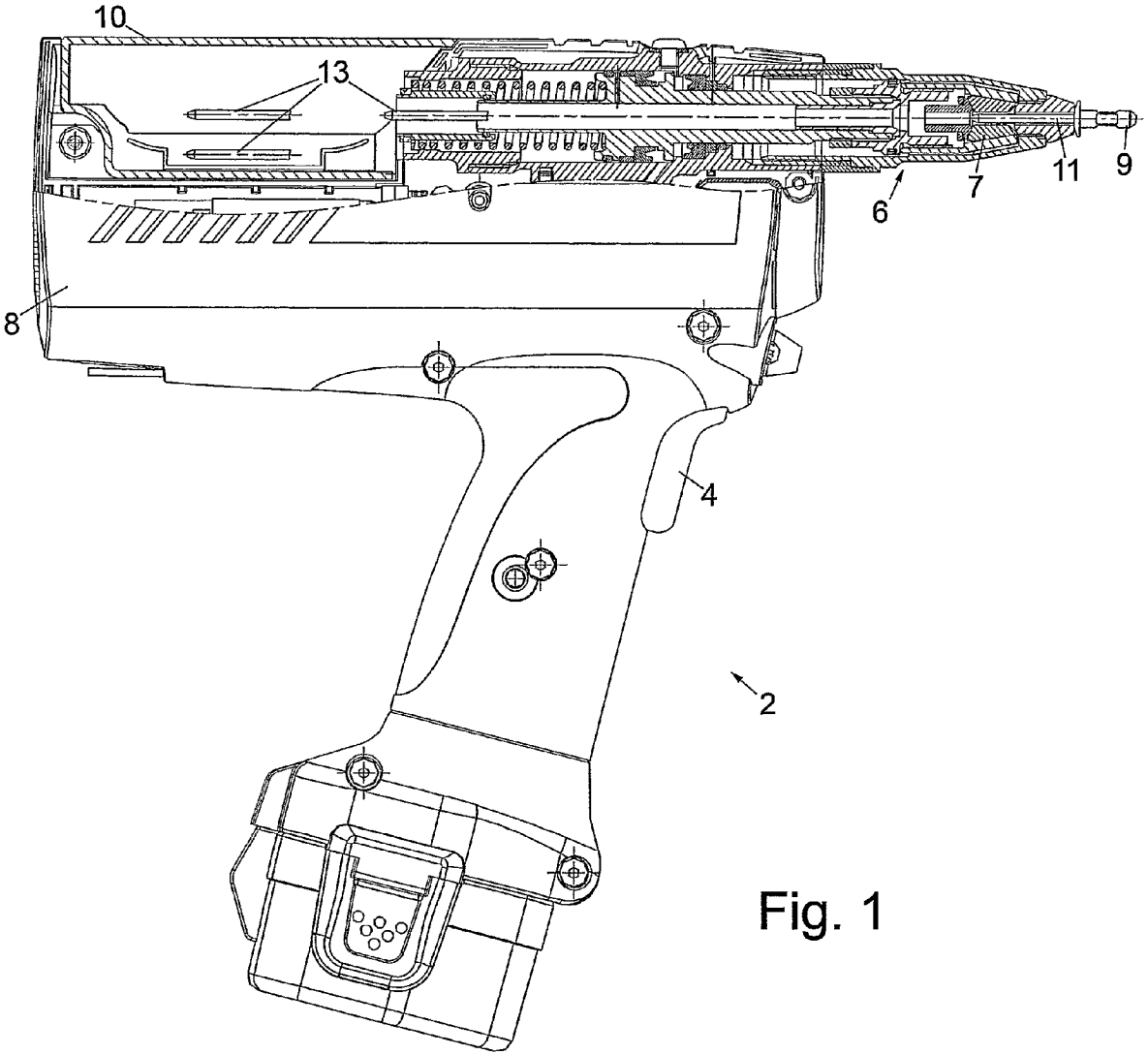
FIG. 1 illustrates a breakstem riveting tool having a stem collection container according to embodiments of the invention.
Figure 2:
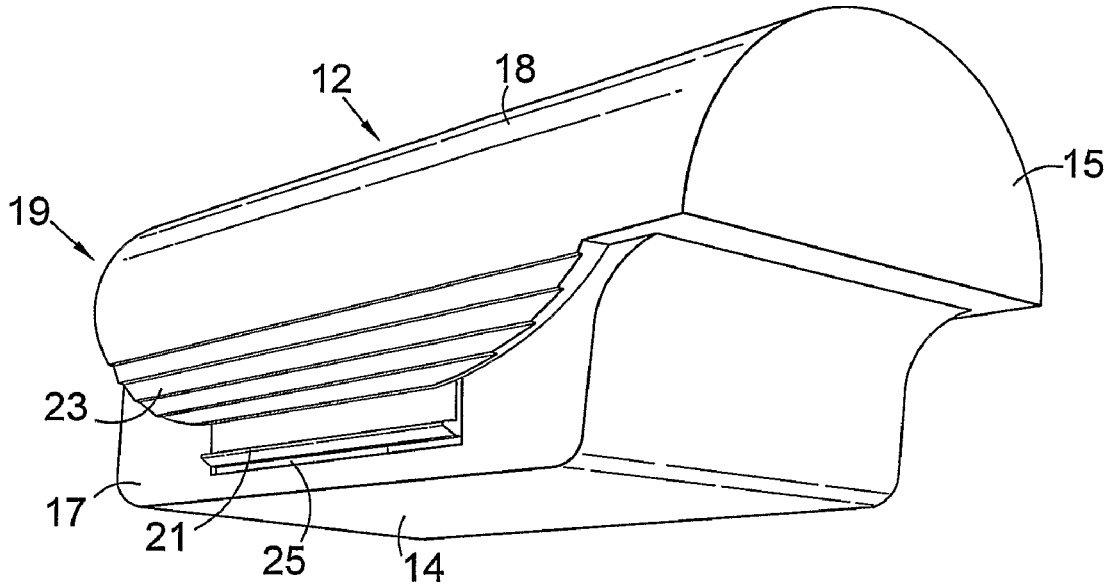
FIGS. 2 and 3 illustrate views of a first embodiment of a stem collection container, made from a semi-rigid material such as polycarbonate.
Figure 2:
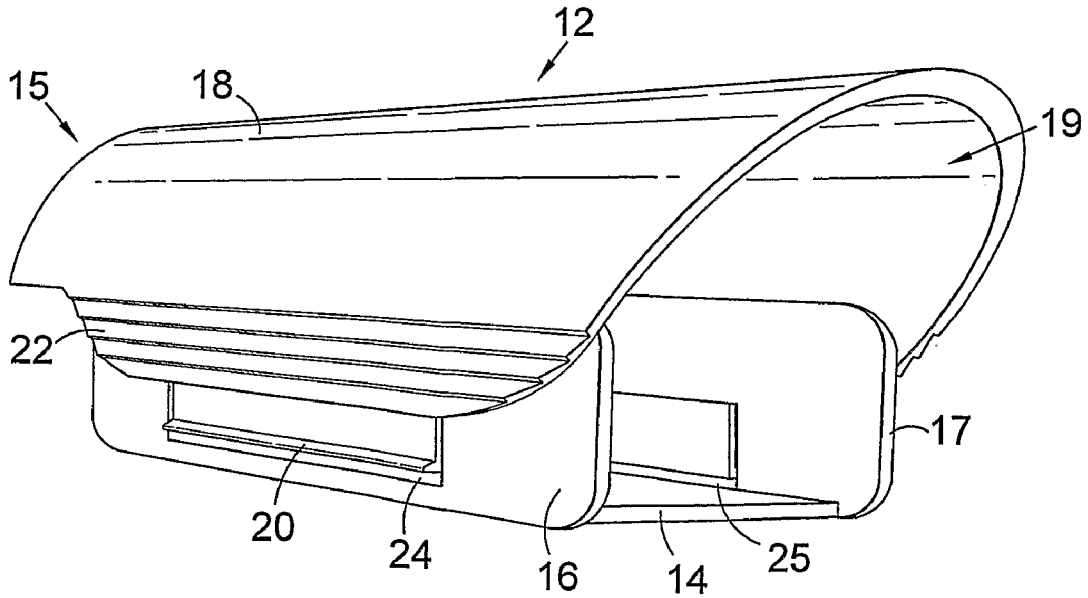
Figure 3:
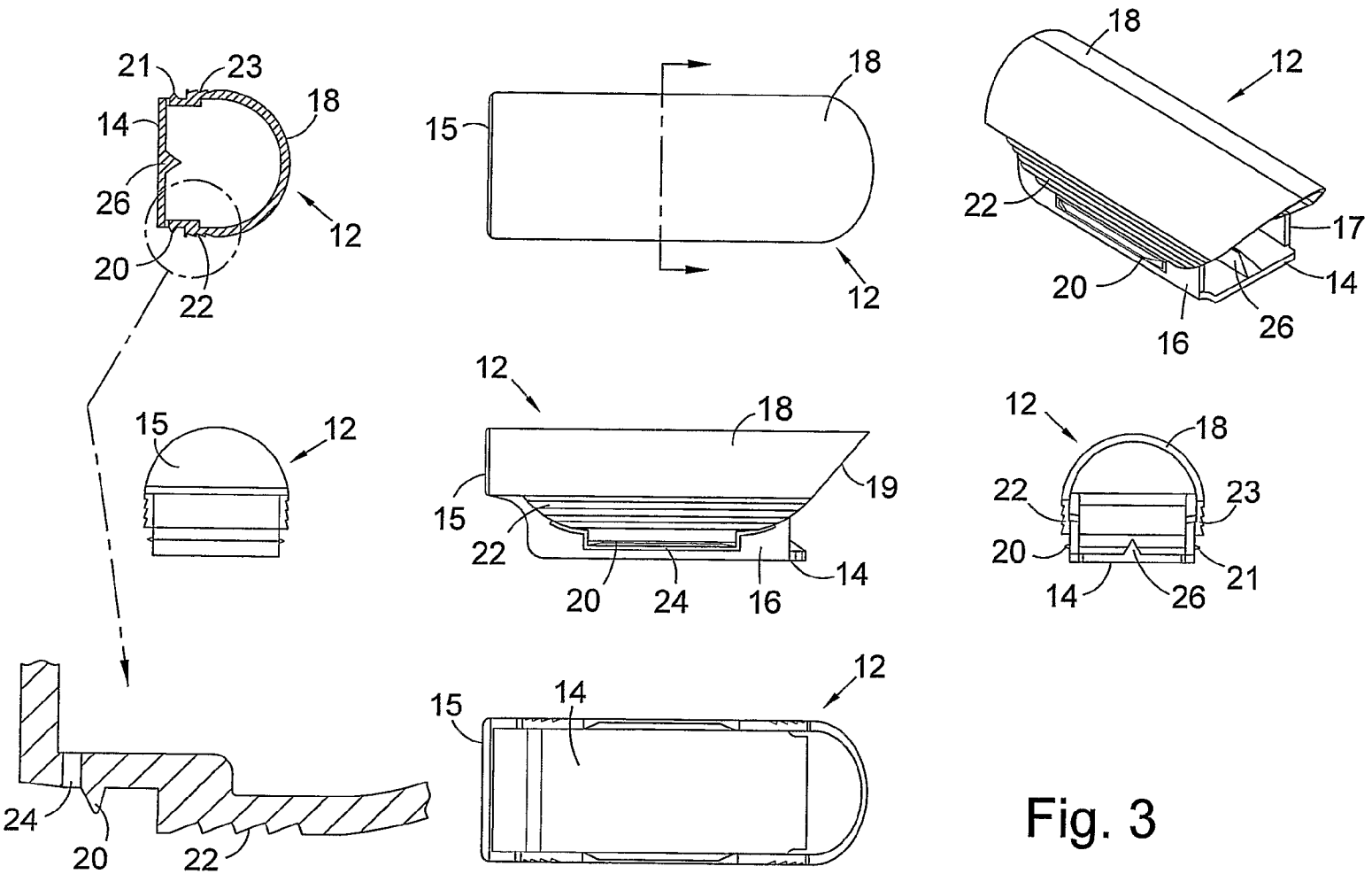

FIG. 1 shows an overview of a breakstem riveting tool 2 having a body 8. The tool 2 is used for installing breakstem rivets 9. As will be familiar to those skilled in the art, the tool 2 has a nosepiece assembly 6 which contains stem-gripping jaws 7 for gripping and pulling the stem 11 of a rivet 9 which has been inserted in the tool. When the operator depresses the trigger 4, the jaws 7 pull the stem 11 of the rivet 9, which causes the shell of the rivet 9 to deform and, eventually, the stem 11 of the rivet 9 to break. The jaws 7 then release the broken stem 13 which is ejected rearwardly through the nosepiece assembly 6, towards the back of the tool. The broken stems 13 are collected in a stem collection container 10 which is attached to the body 8 of the tool 2.

FIGS. 2 to 6 illustrate a first embodiment of a stem collection container 12. The container 12 is designed for one-handed quick release from the body 8 of the tool 2, to enable the user to empty broken-off rivet stems from the container 12. The container 12 may then be quickly reattached to the body 8.

The container 12 comprises a base 14, a first side wall 16, a second side wall 17, a top 18, a back 15 (in this case, profiled to correspond with the geometry of the body 8), and an opening 19 through which ejected rivet stems are received.

The first side wall 16 is formed to integrally incorporate a protrusion 20 which serves as attachment means for attaching the container 12 to the body 8. Similarly the second side wall 17 is formed to integrally incorporate a protrusion 21 which also serves as attachment means for attaching the container 12 to the body 8. The protrusions 20, 21 protrude perpendicularly from the walls 16, 17, and extend as elongate ridges along the sides of the container 12.

Figure 5:
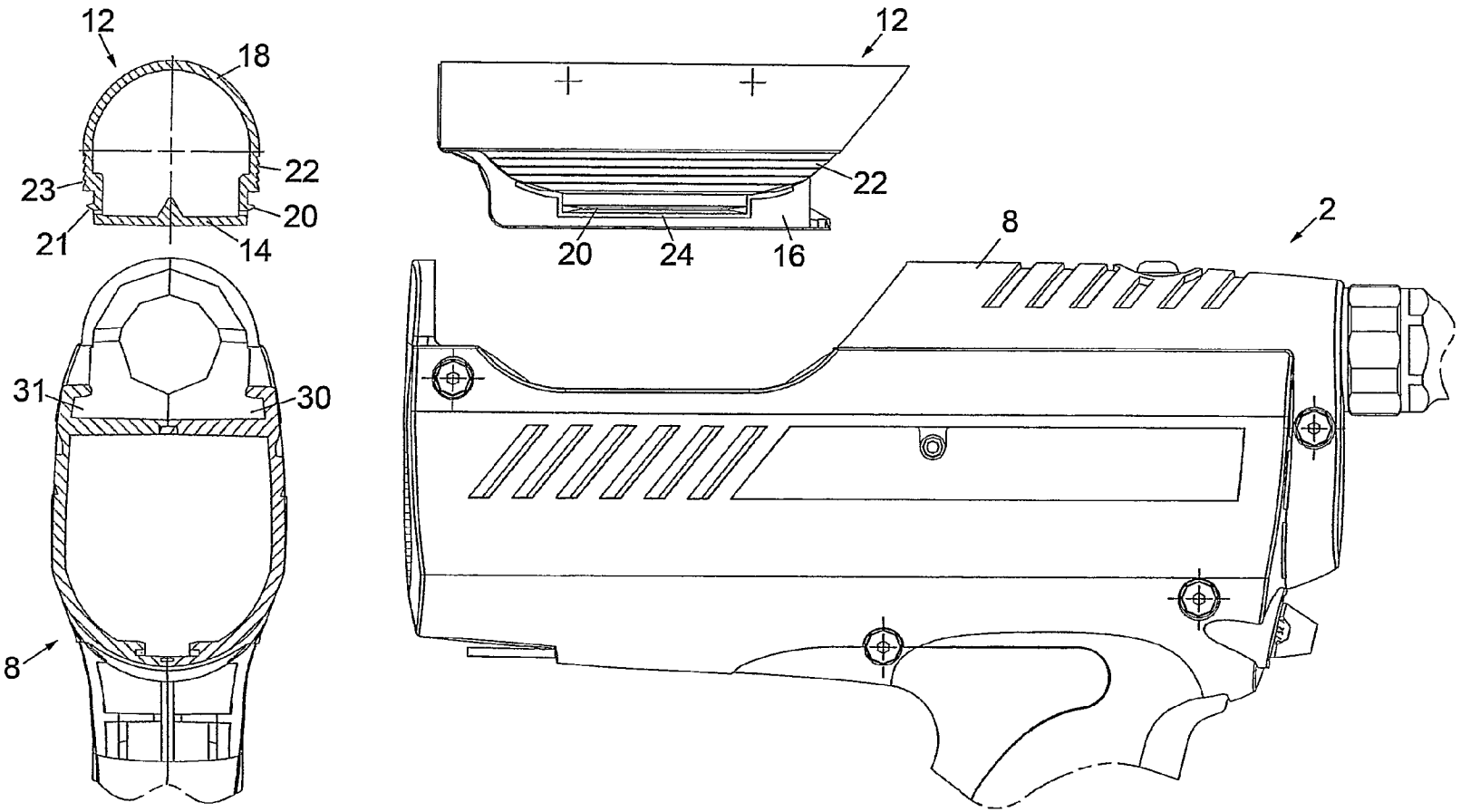
FIG. 5 illustrates views of the container of FIGS. 2 to 4 detached from a riveting tool.
Figure 6:
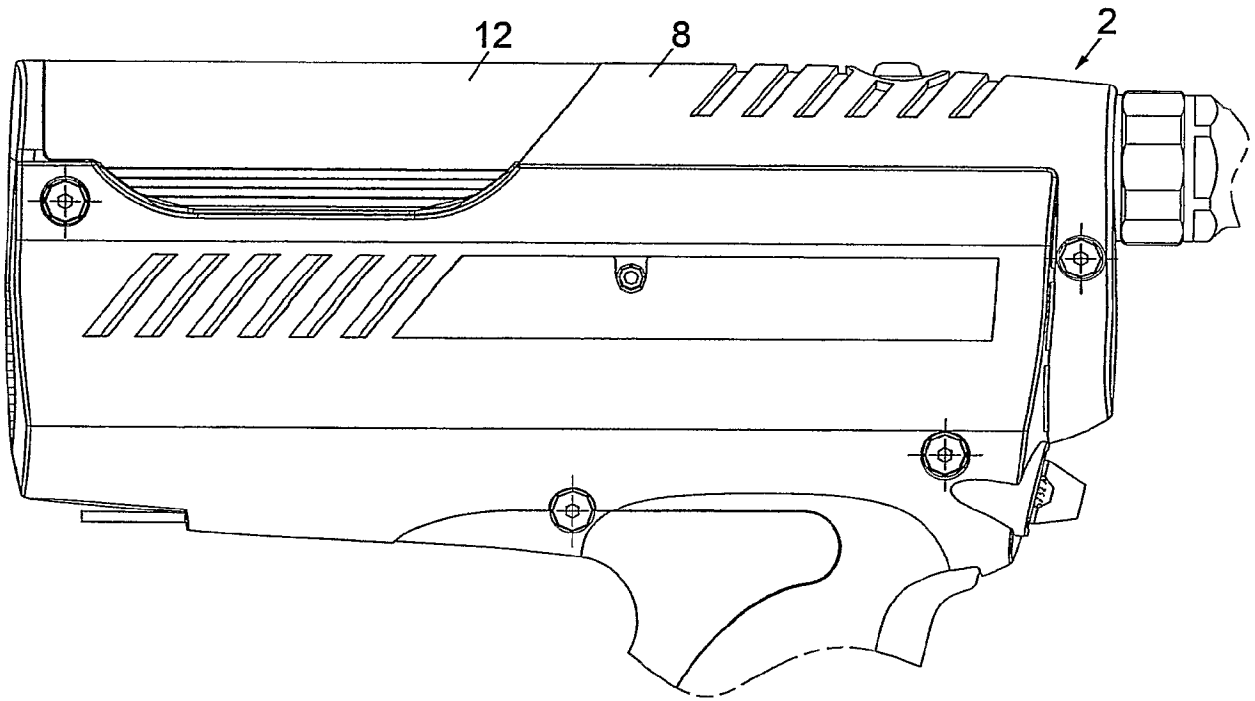
FIG. 6 illustrates views of the container of FIGS. 2 to 4 attached to the riveting tool.
Figure 6:
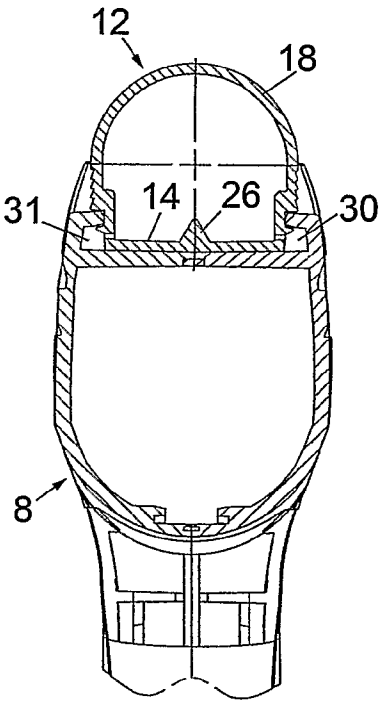
Figure 7:
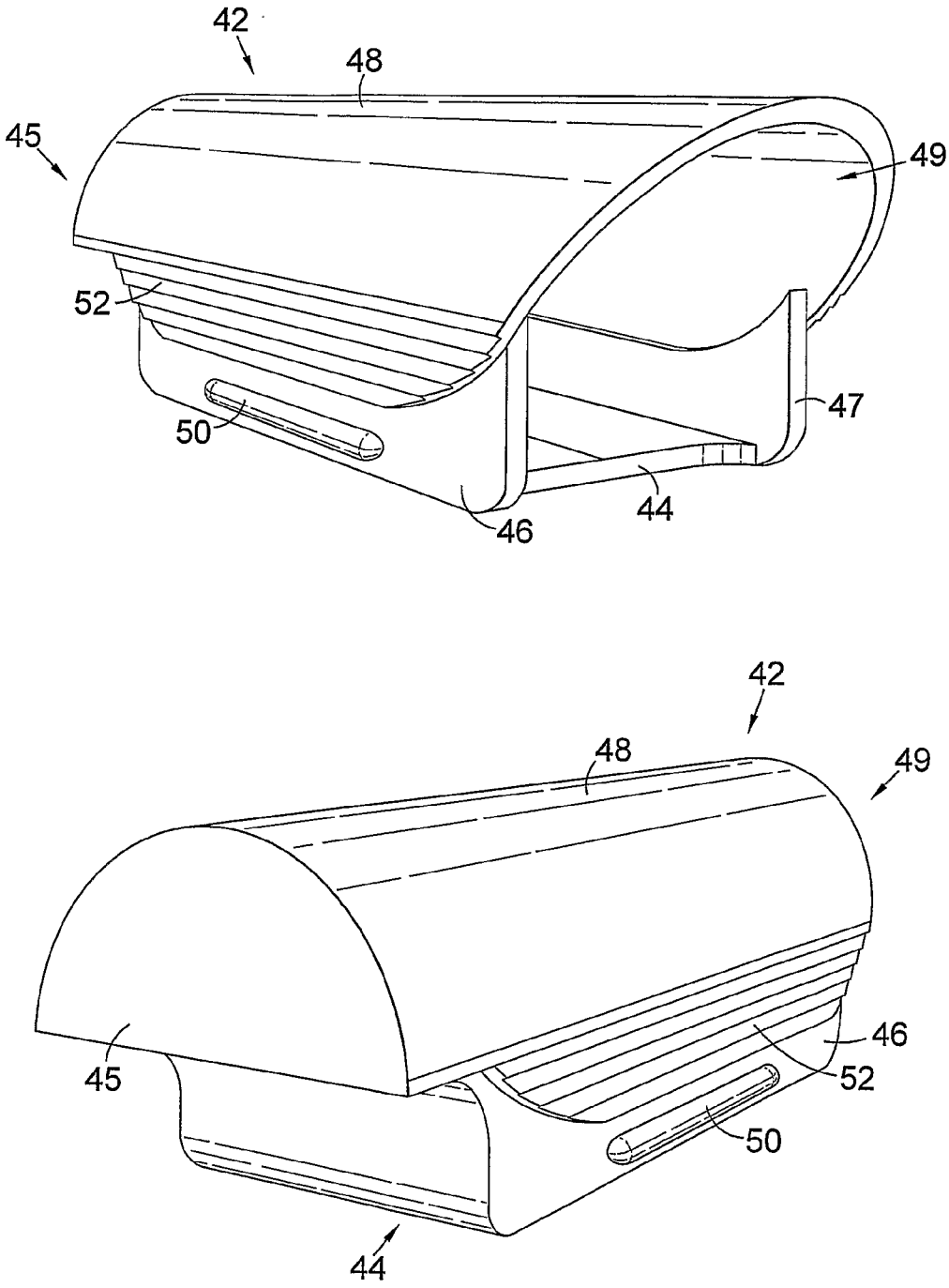
FIGS. 7 and 8 illustrate views of a second embodiment of a container, made from a flexible rubber material.
Figure 8:
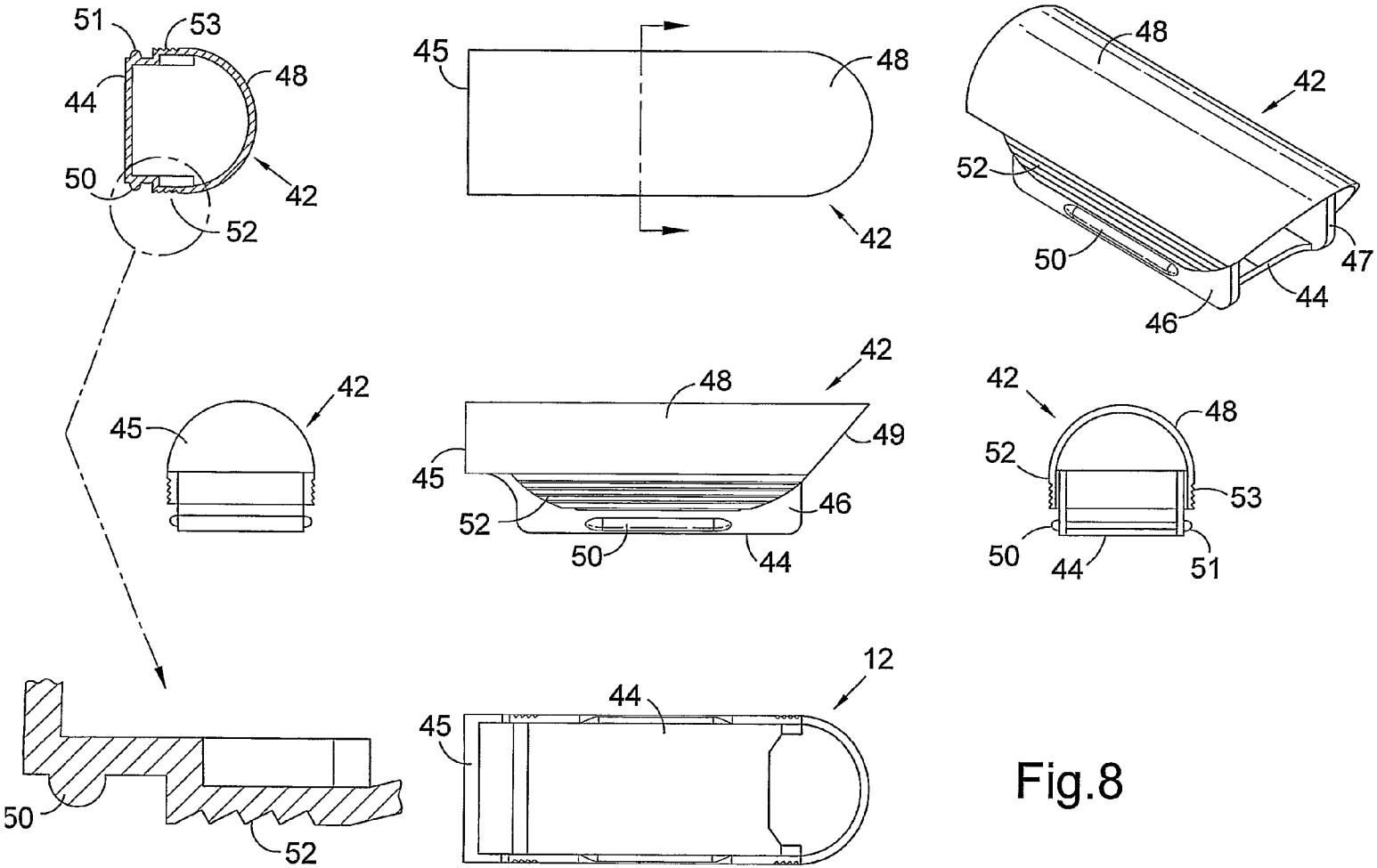

The protrusions 20, 21 are shaped and configured to engage with corresponding recesses 30, 31 formed in the body 8 of the tool 2, as shown in FIGS. 5 and 6. The protrusions 20, 21 are resiliently biased into engagement with the recesses 30, 31 by virtue of the walls 16, 17 of the container 12 (at least in the vicinity of the protrusions 20, 21) being made of resiliently flexible material. Thus, the resiliently flexible material serves as resilient biasing means for the protrusions 20, 21.

When the container 12 is offered up to the body 8 for attachment, the protrusions 20, 21 resiliently deform slightly as they pass over the rim of the body above the recesses 30, 31. Once the container 12 is in place on the body 8, the protrusions 20, 21 resiliently recover their original configuration and clip into the recesses 30, 31.

To enable quick release of the container 12 from the body 8, the first side wall 16 is formed to integrally incorporate a contact region 22 for receiving manual pressure from the user's thumb or finger(s). The contact region 22 is coupled to the protrusion 20 via the material of the wall 16. Similarly, the second side wall 17 is formed to integrally incorporate a contact region 23 for receiving manual pressure from the user's finger(s) or thumb. The contact region 23 is coupled to the protrusion 21 via the material of the wall 17. The flexural properties of the walls 16, 17 are such that, by the user gripping the contact regions 22, 23 between his thumb and finger(s) and squeezing the contact regions 22, 23 towards each other, the protrusions 20, 21 may be moved against the resilient bias and may thus be detached from the recesses 30, 31 respectively. Thus, the container 12 may readily be detached from the body 8 in a quick release manner, using just one of the operator's hands.

Outwardly, the contact regions 22, 23 may incorporate some gripping ridges to facilitate manual contact by the user.

It will be appreciated that the flexural properties of the walls 16, 17 (at least in the vicinity of the protrusions 20, 21 and the contact regions 22, 23) need to be such that the user can disengage the protrusions 20, 21 from the recesses 30, 31 by applying an appropriate amount of manual pressure on the contact regions 22, 23, but that the protrusions must nevertheless be sufficiently biased into engagement with the recesses such that the container 12 does not inadvertently become detached during use.

Suitable materials from which the container 12 may be made include semi-rigid polymer materials, such as polycarbonates (e.g. Macrolon (®)). Other possible materials include other polymers such as rubber (which is used in the second embodiment, described below), metals, ABS (acrylonitrile butadiene styrene), or composite materials (e.g. glass reinforced plastic).

The container 12 of the first embodiment is preferably made from a polycarbonate material, since this provides an appropriate combination of flexural resilience, stiffness and impact strength (to withstand the broken rivet stems 13 being forcibly ejected into the container 12). Polycarbonate materials enable one-piece moulding of the container 12, provide a positive snap-fit action when the protrusions 20, 21 engage with the recesses 30, 31 of the body 8, and provide reliable retention of the container 12 on the body 8. However, since polycarbonate materials are fairly stiff, to facilitate user manipulation of the contact regions 22, 23, apertures 24, 25 (or "cut-outs") may be provided around the contact regions 22, 23 and/or the protrusions 20, 21. These apertures 24, 25 facilitate movement of the contact regions 22, 23 and the protrusions 20, 21 when manual pressure is applied to the contact regions 22, 23. Instead of providing apertures 24, 25, the wall thickness may be selectively thinned around the contact regions 22, 23 and/or the protrusions 20, 21, for the same purpose.

When ejected into a collection container, a broken stem 13 can potentially jam across the width of the container, between the two side walls 16, 17. This could potentially prevent the user from being able to squeeze the contact regions 22, 23 towards each other, or could prevent the protrusions 20, 21 from being able to move inwards in order to disengage from the recesses 30, 31, or could hamper the release of the stems from the container during emptying. To overcome or at least mitigate these potential problems, a ridge 26 may be provided on the interior of the base 14 of the container 12, the ridge extending along substantially the length of the base 14. The ridge 26 is shaped and configured so that broken stems cannot come to rest across the width of the inside of the container 12, perpendicular to the two side walls 16, 17, and cannot therefore block inward movement of the contact regions 22, 23 or the protrusions 20, 21. Additionally, the release of the stems from the container 12 during emptying will not be hampered. By virtue of the ridge 26, any stems which would otherwise have rested across the width of the container 12 will at the very least be tipped up diagonally, or deflected around to rest lengthwise with the container.

Instead of a ridge 26, one or more protrusions, or a partition, could be provided on an internal surface of the container, so that inward movement of the contact regions 22, 23 or the protrusions 20, 21 cannot be prevented by broken stems resting across the width of the container.

FIGS. 7 to 11 illustrate a second embodiment of a stem collection container 42, made of a flexible nitrile rubber material, preferably using one-piece moulding. As with the first embodiment, the container 42 is designed for one-handed quick release from the body 8 of the tool 2, and for quick and easy reattachment to the body 8. The principles of operation are substantially the same as with the first embodiment.

The container 42 comprises a base 44, a first side wall 46, a second side wall 47, a top 48, a back 45 (profiled to correspond with the geometry of the body 8), and an opening 49 through which ejected rivet stems are received.

The first side wall 46 is formed to integrally incorporate a protrusion 50 which serves as attachment means for attaching the container 42 to the body 8. Similarly the second side wall 47 is formed to integrally incorporate a protrusion 51 which also serves as attachment means for attaching the container 42 to the body 8. The protrusions 50, 51 protrude perpendicularly from the walls 46, 47, and extend as elongate ridges along the sides of the container 42.

Figure 10:
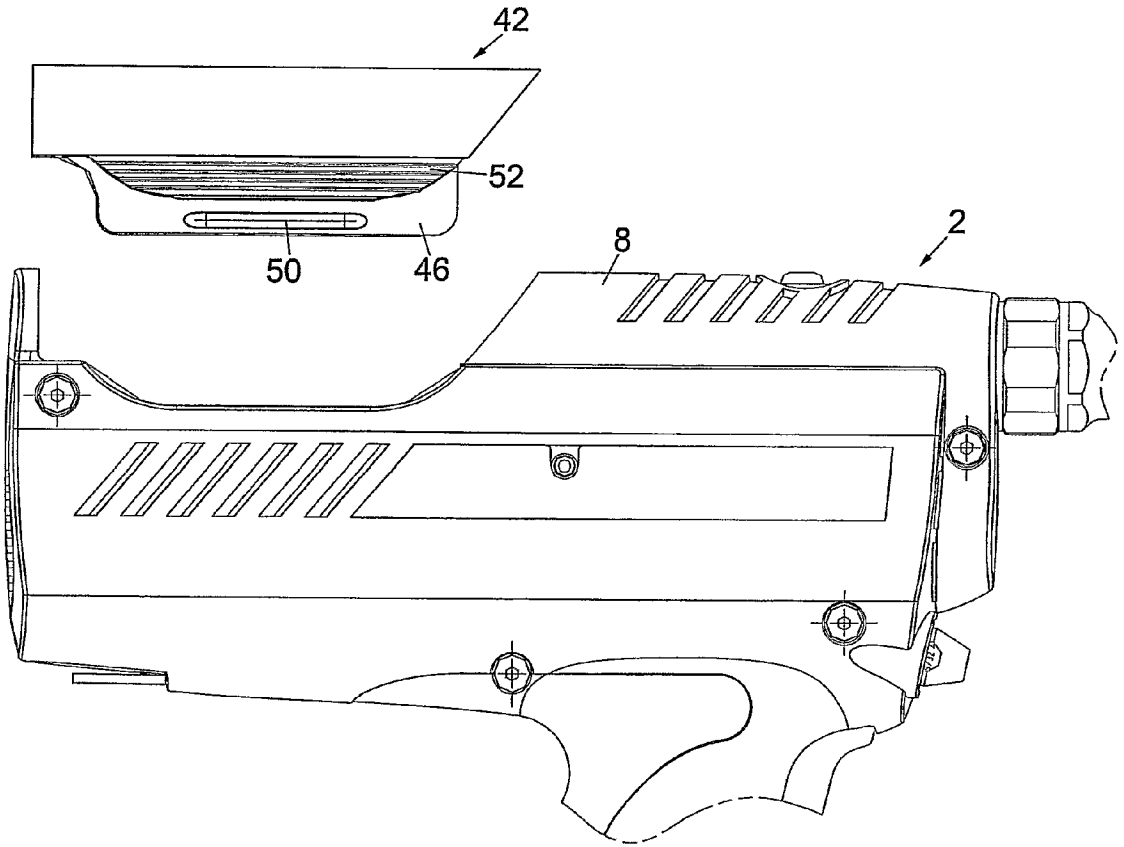
FIG. 10 illustrates views of the container of FIGS. 7 to 9 detached from a riveting tool.
Figure 10:
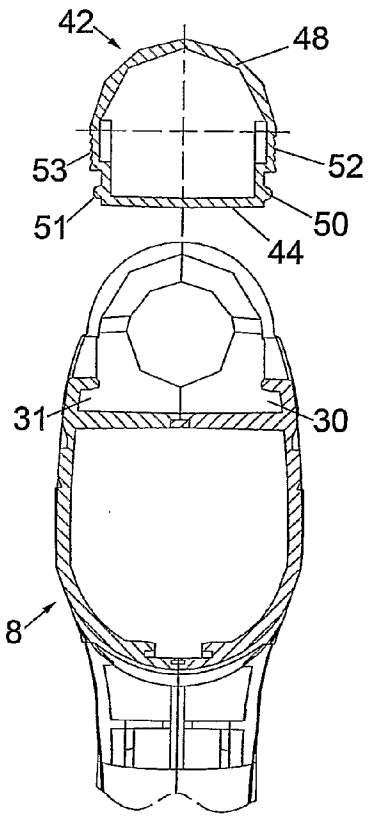
Figure 11:
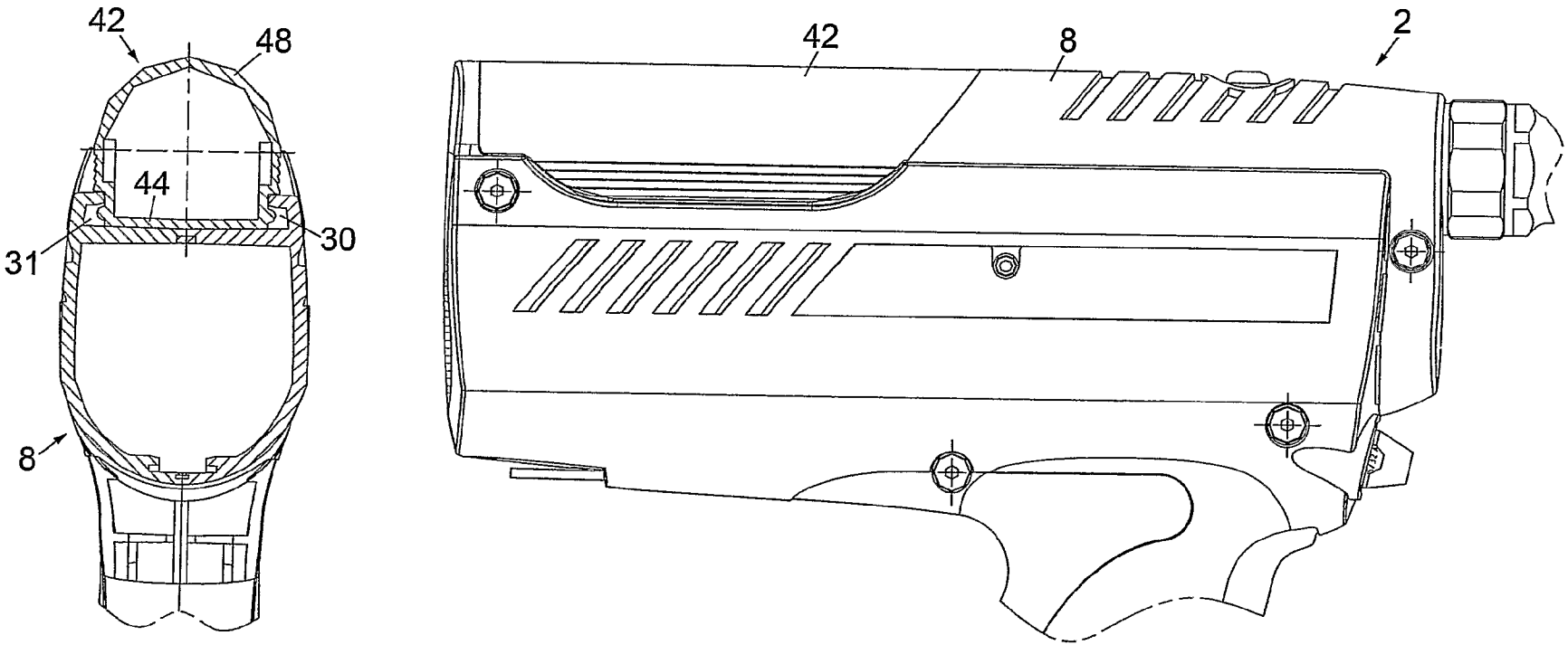
FIG. 11 illustrates views of the container of FIGS. 7 to 9 attached to the riveting tool.

The protrusions 50, 51 are shaped and configured to engage with the corresponding recesses 30, 31 formed in the body 8 of the tool 2, as shown in FIGS. 10 and 11. The protrusions 50, 51 are resiliently biased into engagement with the recesses 30, 31 by virtue of the walls of the container 42 being made of resiliently flexible rubber material.

The first side wall 46 is formed to integrally incorporate a contact region 52 for receiving manual pressure from the user's thumb or finger(s). The contact region 52 is coupled to the protrusion 50 via the material of the wall 46. Similarly, the second side wall 47 is formed to integrally incorporate a contact region 53 for receiving manual pressure from the user's finger(s) or thumb. The contact region 53 is coupled to the protrusion 51 via the material of the wall 47. Outwardly, the contact regions 52, 53 may incorporate some gripping ridges to facilitate manual contact by the user.

As with the first embodiment, the flexural properties of the walls 46, 47 are such that, by the user gripping the contact regions 52, 53 between his thumb and finger(s) and squeezing the contact regions 52, 53 towards each other, the protrusions 50, 51 may be moved against the resilient bias and may thus be detached from the recesses 30, 31 respectively. Thus, the container 12 may readily be detached from the body 8 in a quick release manner, using just one of the operator's hands.

Since rubber is more flexible than polycarbonate material, there is no need for apertures (24, of the first embodiment) to be provided around the contact regions 52, 53 and/or the protrusions 50, 51 of the rubber container 42.

It is also envisaged that there is no need to provide a ridge, protrusion(s) or partition (e.g. 26 of the first embodiment) on an internal surface of the rubber container 42, since any stems which come to rest across the width of the container may be released by squeezing the container in general. However, if required, such a ridge, protrusion(s) or partition may be formed on an internal surface of the rubber container 42, as described with the first embodiment.

Figure 12:
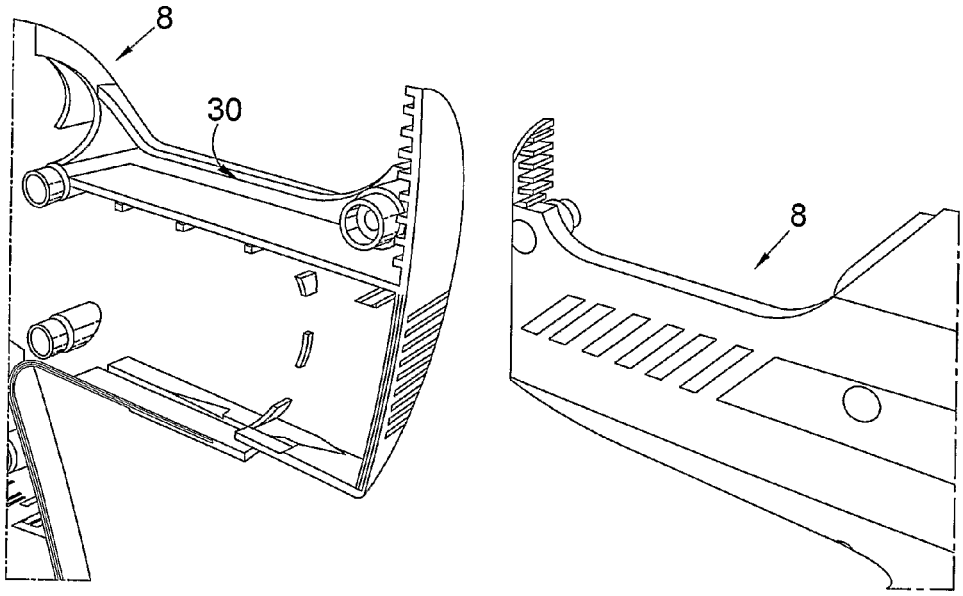
FIG. 12 illustrates a design of a tool body suitable for use with the containers of the first and second embodiments.
Figure 13:
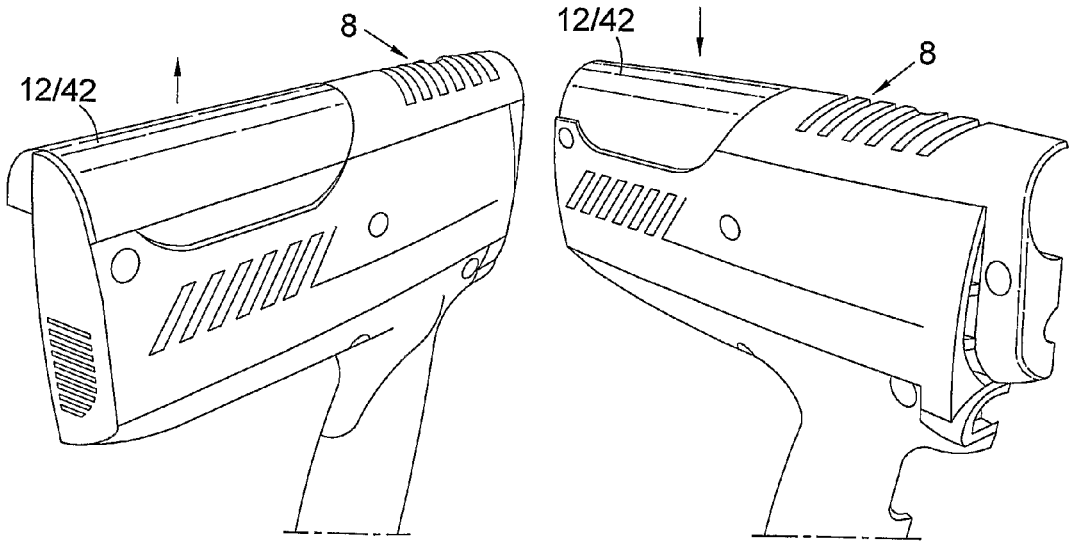
FIG. 13 illustrates a container of the first or second embodiments, attached to the tool body of FIG. 12.

FIG. 12 illustrates a design of a tool body 8 suitable for use with the containers of the first and second embodiments. FIG. 13 illustrates the container 12, 42 of either the first or the second embodiment, attached to the tool body 8.

Figure 14:
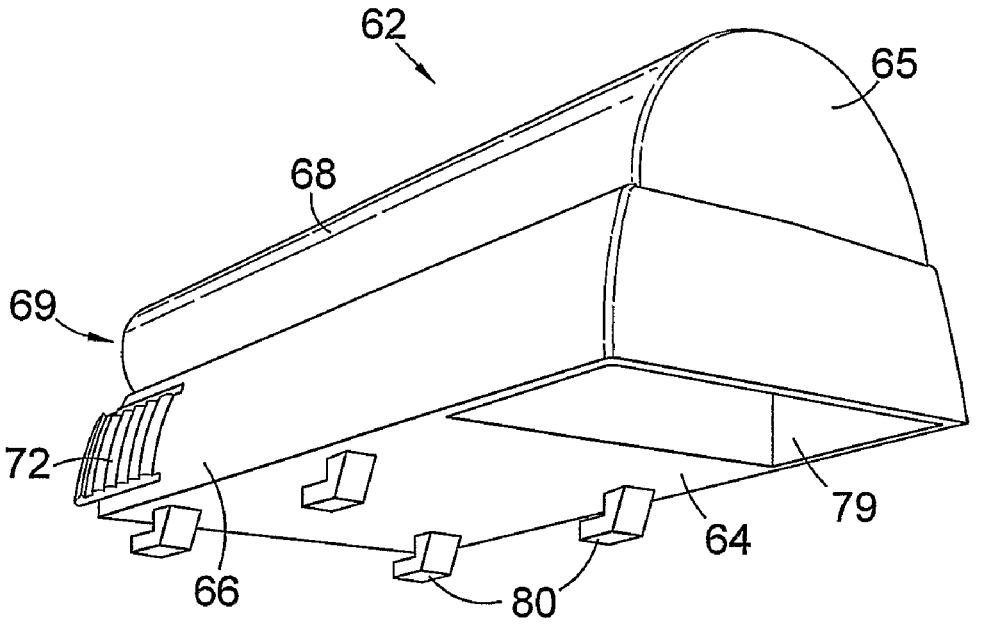
FIG. 14 illustrates views of a third embodiment of a container.
Figure 14:
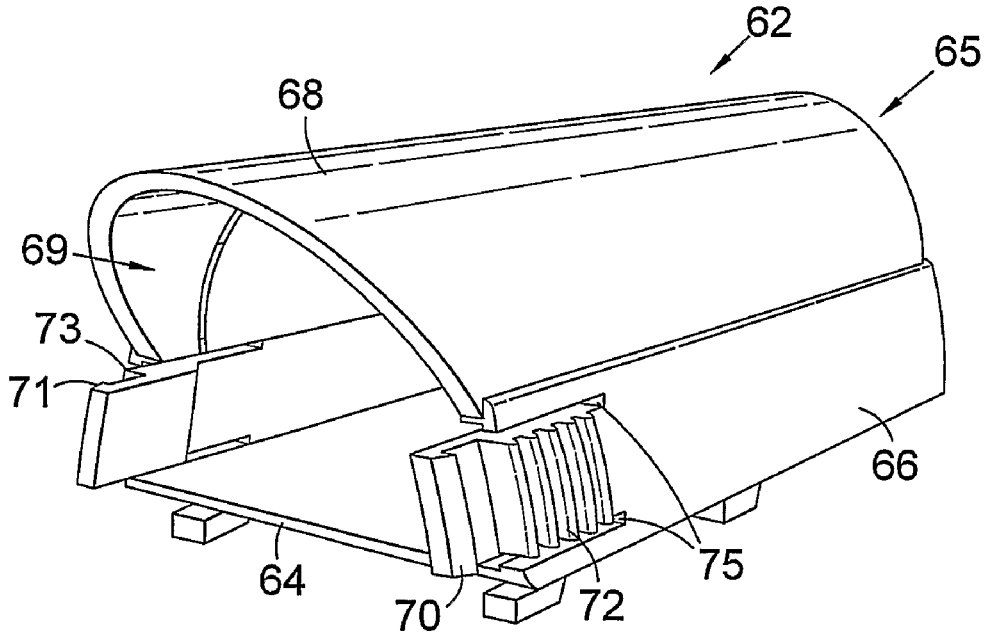
Figure 16:
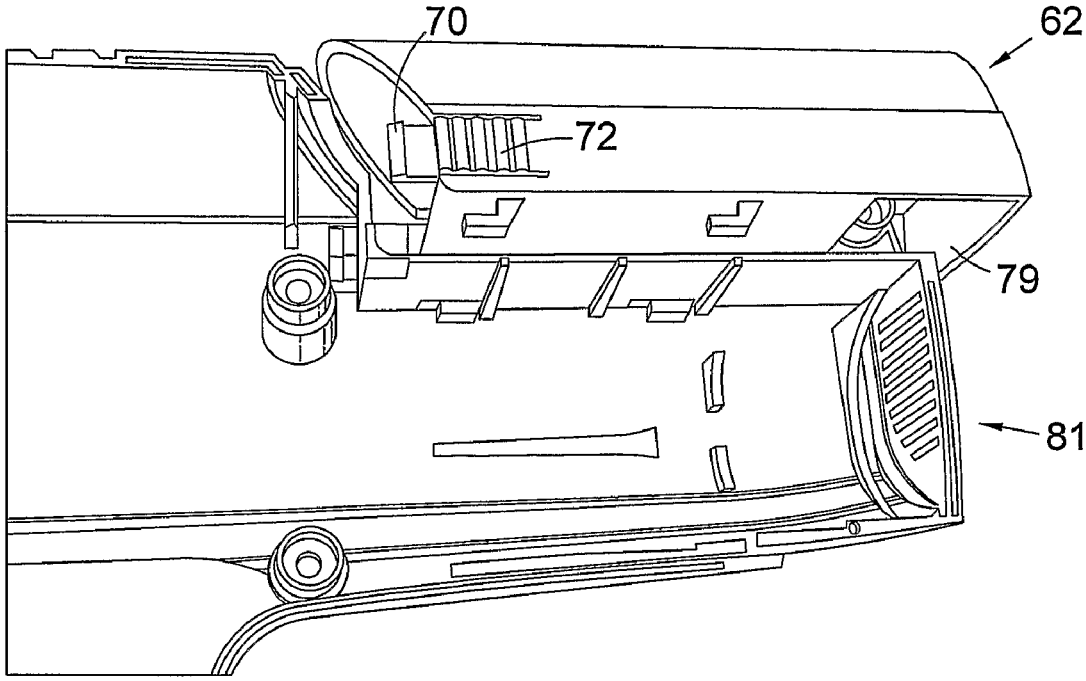
FIG. 16 illustrates the container of the third embodiment being attached to the tool body of FIG. 15.

FIGS. 14, 15 and 16 illustrate a third embodiment of a stem collection container 62, which may be made of a fairly rigid material such as a polycarbonate or a metal. As with the first and second embodiments, the container 62 is designed for one-handed quick release from the body 81 of the tool, and for quick and easy reattachment to the body 81. The principles of operation are substantially the same as with the first and second embodiments.

The container 62 comprises a base 64 (incorporating a sunken region 79 to correspond with the geometry of the tool body), a first side wall 66, a second (opposing) side wall, a top 68, a back 65, and an opening 69 through which ejected rivet stems are received.

The first side wall 66 is provided with an arm which extends from the container 62, the arm terminating in a hook-like protrusion 70 to serve as attachment means for attaching the container 62 to the tool body 81. The arm also incorporates a contact region 72 for receiving manual pressure from the user's thumb or finger and thereby moving the protrusion 70. The arm is resiliently biased due to the flexural properties of the material from which it and/or the wall 66 is/are made. Slots 75 may be provided above and below the arm, to facilitate its resilient flexing.

Similarly, the second side wall is also provided with an arm which extends from the container, on which arm another hook-like protrusion 71 and another contact region 73 are provided.

Outwardly, the contact regions 72, 73 may incorporate some gripping ridges to facilitate manual contact by the user.

The protrusions 70, 71 are resiliently biased and shaped and configured to engage through corresponding apertures 82 formed in the tool body 81.

As with the first and second embodiments, the flexural properties of the walls and/or arms are such that, by the user gripping the contact regions 72, 73 between his thumb and finger(s) and squeezing the contact regions 72, 73 towards each other, the protrusions 70, 71 may be moved against the resilient bias and may thus be detached from the recesses 82. Thus, the container 62 may readily be detached from the body 81 in a quick release manner, using just one of the operator's hands.

As with the first and second embodiments, a ridge, protrusion(s) or partition (e.g. 26 of the first embodiment) may be formed on an internal surface of the container 62.

As shown in FIGS. 14 and 16, one or more locating feet 80 may be provided on the base 64 of the container 62. The feet 80 are substantially L-shaped, and are adapted to locate in corresponding apertures 84 in the body 81 of the tool. The feet 80 are engaged with the body 81 by inserting them through the apertures 84 and then sliding the casing forward along the body 81. This happens simultaneously with the engagement of the protrusions 70, 71 into the apertures 82. The feet 80 assist in securing the container 81 to the body of the tool during use, and prevent the container 81 from inadvertently lifting from the body.

It will be appreciated that locating feet 80 may also be provided with the stem collection containers of the first and second embodiments described above, with corresponding apertures in the body of the tool, in order to provide additional retention of the container on the body.

With all the embodiments, it will be appreciated that any protrusions on the stem collection container that serve as attachment means may be substituted by apertures or recesses—in which case any corresponding apertures or recesses on the tool body would be substituted with protrusions to engage with the apertures or recesses on the container.

With all the embodiments, a buffer or cushion may be provided at the end of the container, for example on wall 15 (first embodiment), wall 45 (second embodiment) or wall 65 (third embodiment), to cushion the impact of the broken stems during ejection.

Although the presently described embodiments all show the stem collection containers as having a unitary construction, this is not necessary. For example, the attachment means, contact regions and resilient biasing means may be provided as separate elements that are attached to the rest of the container during manufacture.

Additionally, it should be emphasised that, if the resilient flexing is provided by virtue of the flexural properties of a material from which the container is made, then only those regions of the container which need to flex need to be made from that material. Thus, the container could be made as a two-shot moulding, from two different materials, for example, with the materials being selected according to their properties and purpose. Alternatively, the container could be made from a single material, but the material being engineered such that it has certain flexural characteristics in the regions in which flexing is required, and different (e.g. stiffer) flexural characteristics in the regions in which flexing is not required.

It will be appreciated that the stem collection containers described herein generally require a modified tool body onto which the container engages. Such modifications may comprise incorporating some apertures or recesses to the body moulding, for example. However, in some cases, one of the present containers may be retrofitted to an existing tool body, without modification of the body, depending on the geometry of the container and the body.

In use, a breakstem riveting tool having one of the present stem collection containers may be emptied of broken rivet stems as follows: The tool is held by the operator in one hand. The container is removed with the operator's other hand, the stems are tipped out, and the container is fitted back into place on the tool. Thus the removal, emptying and reattachment of the container is a quick and simple single-handed operation.

The invention claimed is:

1. A container for use with a tool for installing fasteners of the type in which a part of the fastener is broken off during installation, the tool having a body, the container being for collecting broken-off fastener parts during operation of the tool, the container comprising:

a first wall having a first attachment portion and a first contact region, and a second wall having a second attachment portion and a second contact region, with the first and second attachment portions being integrally formed with the first and second walls respectively, with the first and second attachment portions adapted to removably attach the container to the body of the tool, the attachment portions being resiliently biased into attachment with the body by resilient biasing portions, with at least part of the first and/or second walls being formed of a resiliently flexible material which provides the resilient biasing portions, with the first and second contact regions adapted to receive manual pressure from a user, at least one of the said one or more contact regions being coupled to the attachment portions, with the first and/or second walls having one or more apertures or recesses to facilitate the resilient flexing of the material, and where the resilient biasing portions are such that the attachment portions can be detached from the body of the tool by the user applying manual pressure on the first and second contact regions, thereby detaching the container from the body of the tool.

2. A container as claimed in claim 1, wherein the first wall substantially opposes the second wall.

3. A container as claimed in claim 1, wherein the first and second contact regions are integrally formed in the first and second walls respectively.

4. A container as claimed in claim 1, wherein the resilient material is a polymer material.

5. A container as claimed in claim 4, wherein the resilient material is a polycarbonate material.

6. A container as claimed in claim 4, wherein the resilient material is a rubber material.

7. A container as claimed in claim 1, wherein the resilient material is a metallic material.

8. A container as claimed in claim 1, the first and second attachment portions each comprising one or more protrusions.

9. A container as claimed in claim 8, where the one or more protrusions protrude perpendicularly from the first wall.

10. A container as claimed in claim 9, where the one or more protrusions also protrude perpendicularly from the second wall.

11. A container as claimed in claim 8, wherein the said one or more protrusions are in the form of ridges.

12. A container as claimed in claim 1, further comprising a ridge, protrusion or partition on an internal surface of the container, the said ridge, protrusion or partition being arranged to prevent broken stems from jamming across the width of the container.

13. A fastener installation tool having a container as claimed in claim 1.

14. A container for use with a tool for installing fasteners of the type in which a part of the fastener is broken off during installation, the tool having a body, the container being for collecting broken-off fastener parts during operation of the tool, the container comprising:

an attachment portion removably attaching the container to the body of the tool, the attachment portion being resiliently biased into attachment with the body by a resilient bias, and one or more contact regions adapted to receive manual pressure from a user, at least one of the said one or more contact regions being coupled to the attachment portion, the resilient bias such that the attachment portion can be detached from the body of the tool by the user applying manual pressure on the one or more contact regions, thereby detaching the container from the body of the tool, the container further comprising one or more arms extending from the container, the said arm(s) being resiliently biased and incorporating the attachment portion and a contact region.

15. A container as claimed in claim 14, the attachment portion comprising one or more protrusions.

16. A container for use with a tool for installing fasteners of the type in which a part of the fastener is broken off during installation, the tool having a body, the container being for collecting broken-off fastener parts during operation of the tool, the container comprising:

an attachment portion comprising one or more apertures or recesses, the attachment portion removably attaching the container to the body of the tool, the attachment portion being resiliently biased into attachment with the body by a resilient bias, and one or more contact regions adapted to receive manual pressure from a user, at least one of the said one or more contact regions being coupled to the attachment portion, the resilient bias such that the attachment portion can be detached from the body of the tool by the user applying manual pressure on the one or more contact regions, thereby detaching the container from the body of the tool.

17. A container for use with a tool for installing fasteners of the type in which a part of the fastener is broken off during installation, the tool having a body, the container being for collecting broken-off fastener parts during operation of the tool, the container comprising:

an attachment portion removably attaching the container to the body of the tool, the attachment portion being resiliently biased into attachment with the body by a resilient bias, and one or more contact regions adapted to receive manual pressure from a user, at least one of the said one or more contact regions being coupled to the attachment portion, the resilient bias such that the attachment portion can be detached from the body of the tool by the user applying manual pressure on the one or more contact regions, thereby detaching the container from the body of the tool, the container further comprising one or more feet adapted to locate in one or more corresponding apertures or recesses in the body of the tool.

18. A container as claimed in claim 17, wherein the said one or more feet are substantially L-shaped.

19. A fastener setting tool comprising:

a tool body including a handle portion and a nose piece assembly secured to the handle portion, the nose piece assembly adapted to grip a fastener stem during setting of the fastener and adapted to eject the detached fastener stem towards a container adapted to receive detached fastener stems, the container having an opening adapted to receive detached fastener stems ejected from the nosepiece assembly, the container further comprising a first engagement portion and the tool body further comprising a second engagement portion and, where the first engagement portion and the second engagement portion cooperate to releasably attach the container to the tool body, and where at least one of the first engagement portion and the second engagement portion is resiliently biased into engagement with the other one of the first engagement portion and the second engagement portion.

20. The fastener setting tool as claimed in claim 19, where the container comprises resiliently flexible material.

21. The fastener setting tool as claimed in claim 19, where the container further comprises a contact portion coupled to the second engagement portion adapted to receive manual pressure from a user.

22. The fastener setting tool as claimed in claim 19, the container further comprises a bottom portion, where the first engagement portion comprises protrusions extending from the bottom portion and the second engagement portion comprises apertures in the tool body corresponding to the protrusions extending from the bottom portion of the container.

23. The fastener setting tool as claimed in claim 19, where the first engagement portion comprises protrusions extending from the container and the second engagement portion comprises corresponding apertures in the tool body, where the protrusions and corresponding apertures cooperate to releasably retain the container to the tool body.

24. The fastener setting tool as claimed in claim 19, where the second engagement portion comprises protrusions extending from the tool body and the first engagement portion comprises corresponding apertures in the container, where the protrusions and corresponding apertures cooperate to releasably retain the container to the tool body.

25. The fastener setting tool as claimed in claim 19, where the first engagement portion comprises one or more arms extending from the container, each arm being resiliently biased and adapted to engagement the first engagement portion.

26. The fastener setting tool as claimed in claim 19, where at least one of the first engagement portion and the second engagement portion comprise metallic material.

27. A container for use with a break stem fastener setting tool comprising:

a container body having an opening adapted to receive detached fastener stems during operation of the tool, an attachment portion adapted to releasably retain the container to a tool body, the attachment portion including at least one protrusion, each protrusion being resiliently biased into a corresponding aperture of the tool body; and at least one contact portion coupled to the attachment portion adapted to receive manual pressure to release the attachment portion of the container from the engagement portion of the tool body to release the container from the tool.

28. The container for use with a break stem fastener setting tool as claimed in claim 27, where the attachment portion of the container comprises at least one aperture configured to cooperate with the engagement portion of the tool body.

29. The container for use with a break stem fastener setting tool as claimed in claim 27, the attachment portion being integrally formed with the container body.

* * * * *